US005186143A

United States Patent [19]

Laufer

[11] Patent Number: 5,186,143

[45] Date of Patent: Feb. 16, 1993

[54] FUEL INJECTION PUMP FOR INTERNAL COMBUSTION ENGINES

[75] Inventor: Helmut Laufer, Gerlingen, Fed. Rep. of Germany

[73] Assignee: Robert Bosch GmbH, Stuttgart, Fed. Rep. of Germany

[21] Appl. No.: 679,034

[22] PCT Filed: Oct. 25, 1990

[86] PCT No.: PCT/DE90/00809

§ 371 Date: May 15, 1991

§ 102(e) Date: May 15, 1991

[87] PCT Pub. No.: WO91/07584

PCT Pub. Date: May 30, 1991

[30] Foreign Application Priority Data

Nov. 15, 1989 [DE] Fed. Rep. of Germany ..... 3937922

[51] Int. Cl.[5] ..... F02M 39/00

[52] U.S. Cl. ..... 123/357; 123/449

[58] Field of Search ..... 123/449, 357, 358, 359, 123/503

[56] References Cited

U.S. PATENT DOCUMENTS

| | | | |
|---|---|---|---|
| 4,432,319 | 2/1984 | Yasuhara | 123/357 |
| 4,465,044 | 8/1984 | Yasuhara | 123/357 |
| 4,470,763 | 9/1984 | Yasuhara | 123/357 |
| 4,526,145 | 7/1985 | Honma | 123/449 |
| 4,635,602 | 1/1987 | Eheim | 123/449 |
| 4,664,079 | 5/1987 | Sakuranaka | 123/370 |
| 4,873,959 | 10/1989 | Law | 123/370 |
| 4,884,542 | 12/1989 | Konrath | 123/370 |
| 4,917,065 | 4/1990 | Law | 123/370 |
| 5,044,890 | 9/1991 | Loeffler | 123/449 |

*Primary Examiner*—Carl S. Miller

*Attorney, Agent, or Firm*—Edwin E. Greigg; Ronald E. Greigg

[57] ABSTRACT

A distributor type fuel injection pump has a rotary magnet regulator (15) to actuate a control member (14) determining the fuel injection quantity, which rotary magnet regulator (15) is driven by a regulating signal produced in dependence on the operational parameters of the internal combustion engine. The rotary magnet regulator (15) is accommodated in a chamber (16) forming part of the pump housing (17) and filled with fuel. A damping device (25) is provided for the purpose of avoiding rotary oscillations of the rotating armature (20) in the rotary magnet regulator (15), which damping device (25) consist of a paddle (26) fixed firmly to the rotating armature (20) and of two separating walls (27,28) provided in the chamber (16). The paddle (26) extends radially from the rotating armature (20) and nearly fills the entire clear cross-section of the chamber (16) available for the swing movement of the paddle. The separating walls (27,28) separate a chamber section (161) comprising the entire range of swing of the paddle (26) from the remaining chamber section (162), whereby however throttle openings ensure a flow of fuel between the chamber section (161) and the chamber section (162) (FIG. 2).

7 Claims, 2 Drawing Sheets

FUEL INJECTION PUMP FOR INTERNAL COMBUSTION ENGINES

STATE OF THE ART

The invention is directed to a distribution type fuel injection pump for internal combustion engines.

In such distributor type fuel injection pumps an exciting signal derived from the operating conditions of the internal combustion engine, such as speed, accelerator pedal position, inlet manifold pressure, temperature, air pressure etc., is transmitted to the rotary magnet regulator, which signal effects a corresponding rotation of the rotating armature and hence a predetermined setting of the control member constructed as a sliding bush on the pump plunger. The rotational position of the rotating armature is detected by a potentiometer, the output signal of which represents the instantaneous value signal of the control member transmitted to the regular device. A damping device for the rotating armature is provided in order to prevent rotary oscillations of the rotating armature which can cause malfunction of the driving operation to the point of stoppage of the internal combustion engine.

In a known fuel injection pump of the above mentioned type (U.S. Pat. No. 4,465,044) the damping device comprises of a damping cylinder in which a damping plunger is translatably guided in an axial direction. The damping plunger has a throttle hole passing through it by which the inside of the damping cylinder filled with fuel is connected to the chamber containing the rotary magnet regulator. The damping plunger is linked by a connecting rod to an arm which is joined firmly to the rotating armature so that it performs a corresponding translational movement when there is a rotary movement of the rotating armature. Due to the fact that during the displacement of the damping plunger, the volume of fuel enclosed by it in the damping cylinder can only be equalised through the throttle area, the rotation of the rotating armature takes place against a resistance depending on the size of the throttle area, as a result of which rapid rotary movements of the rotating armature are suppressed.

ADVANTAGES OF THE INVENTION

The fuel injection pump in accordance with the invention, has the advantage that an effective damping device for the rotating armature is obtained by simple means. At the same time a travel of swing of the paddle is available which is relatively large in relation to the regulating travel of the control member. The damping device in accordance with the invention has an extremely low sensitivity to jamming and to dirt. Due to the very good damping effect of the damping device in accordance with the invention it is possible to increase the regulator amplification resulting in a better low-level signal behaviour of the rotating armature.

DRAWING

The invention is explained in greater detail in the subsequent description, by means of a pictorially presented embodiment. The following are shown:

FIG. 1 a cut-away longitudinal section of a fuel injection pump for an internal combustion engine along line I—I in FIG. 2, and FIG. 2 a top view of the rotary magnet regulator of the fuel injection pump in FIG. 1, with the housing cover removed.

DESCRIPTION OF THE EMBODIMENT

Figure 1:
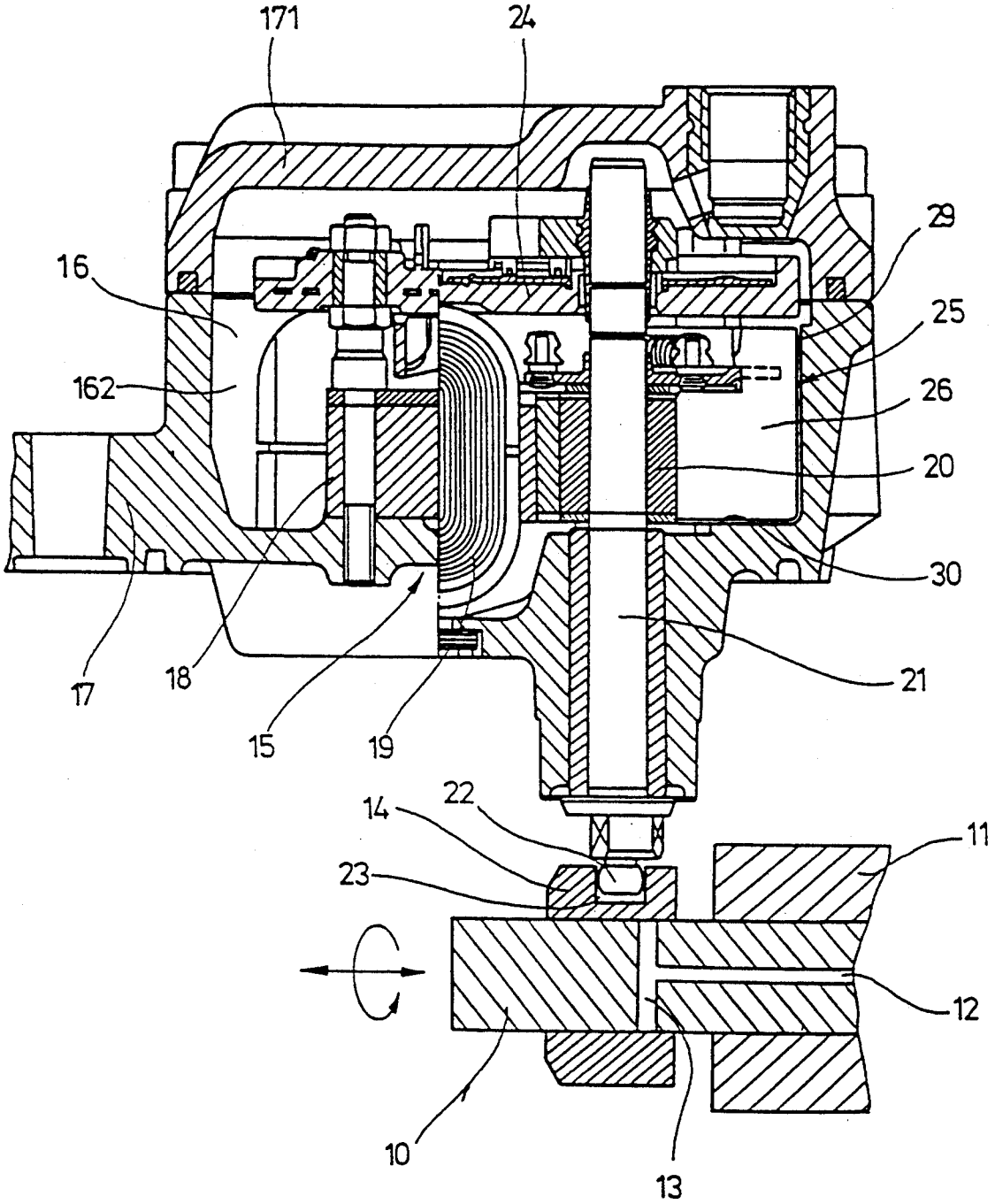

In the distributor type fuel injection pump for internal combustion engines shown in cut-away longitudinal section in FIG. 1 only those parts necessary for the understanding of the invention are represented.

Of the fuel injection pump, a distributor plunger marked 10 actuated in an axial and rotating motion and guided in a pump cylinder 11 in a pump housing marked 17 is indicated. The distributor plunger 10 confines within the pump cylinder 11 in a known manner, a pump operating chamber which, in the course of the stroke of the distributor plunger 10, is connected through an inlet hole to, and again separated from, a volume of fuel inside the pump housing 17. In the course of the stroke of the distributor plunger 10 fuel is thereby drawn from the fuel volume and delivered during the rotary movement through a distributor hole into distributor channels leading to injection nozzles. The pump operating chamber is connected through an axial hole 12 to a control hole 13 running radially. The outlet of the control hole 13 at the circumference of the distributor plunger 10 is covered by means of a control member 14 which is constructed in the form of a sliding bush movable in an axial direction on the distributor plunger 10. Depending on the position of the control member 14 relative to the distributor plunger 10, the control hole 13 comes out of the control member 14 after a smaller or greater axial stroke of the distributor plunger 10, whereby the pump operating chamber is connected to the fuel volume by the control hole 13 and the fuel in the pump operating chamber is fed back into this fuel volume.

The control member 14 is actuated by the rotary magnet regulator 15 which moves the control member 14 in one or the other direction relative to the distributor plunger 10 according to a regulator signal transmitted to it from a regulating device. The rotary magnet regulator 15 is accommodated in a chamber 16 of the pump housing 17. The chamber 16 is connected with the fuel volume inside pump housing 17 so that it is always full of fuel. The rotary magnet regulator 15 consists of a magnet yoke 18, an exciter coil 19 encircling the magnet yoke 18, and a rotating armature 20 fitted between the pole shoes of the magnet yoke 18 so that it can rotate. The rotating armature 10 is fitted on a regulating spindle 21 located in the pump housing 17 in such a manner that it cannot rotate relative to this spindle 21 which carries at its free end an eccentric 22 which protrudes into a recess 23 in the control member 14. When the regulating spindle 21 rotates, this rotary travel is converted by the eccentric 22 into a translational travel of the control member 14. The rotary movement of the rotating armature 20 is discerned by a potentiometer 24 the output signal of which is fed back to the regulating device and forms there the instantaneous value signal for the setting of the control member 14.

Figure 2:
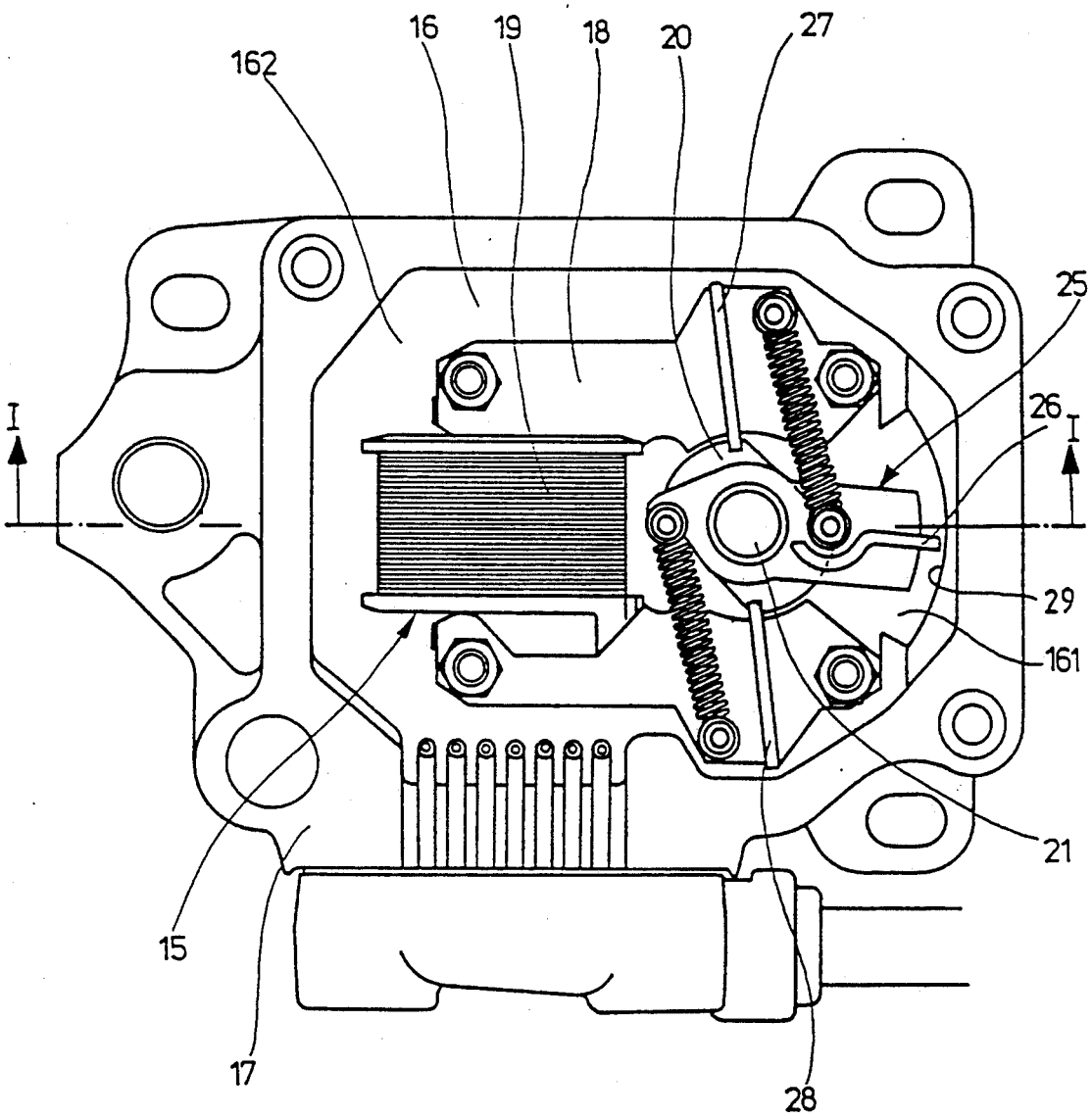

A damping device 25 is integrated in the chamber 16 for the purpose of suppressing undesirable rotary oscillations of the rotating armature 20 which can cause malfunctions in the driving operation. This comprises a paddle 26 made of a piece of sheet material and two separating walls 27, 18 also made of a piece of sheet material and fixed in the chamber 16 (FIG. 2). The paddle 26 is rigidly fixed to the rotating armature 20, extending in the direction of the axis of the rotating armature 20 and projecting radially from it. The paddle 26 is so constructed that it nearly fills the available clear cross-section of the chamber 16 throughout the range of swivel of the rotating armature 20, so that only gaps of narrow width remain between the peripheral edges of the paddle 26 and the curved side wall 29 of the chamber 16 on the one hand, and the flat bottom wall 30 of the chamber 16 on the other hand. The two separating walls 27, 28 may be seen in FIG. 2 which shows a top view of the rotary magnet regulator 15 with the cover 171 of the pump housing 17 taken off and the potentiometer 24 removed. The separating walls 27, 28 are so arranged that they separate the chamber section 161 which comprises the entire range of swivel of the paddle 26, from the remaining chamber section 162, whereby however a connection remains through throttle openings for the exchange of fuel between the chamber section 161 and 162. The throttle openings are formed by the outlet gaps between the peripheral edges of the separating walls 27, 28 and the inside wall of the chamber 16, for example the bottom wall 30, or between the peripheral edges of the separating walls 27, 28 and the rotating armature 20. The paddle 26 and the separating walls 27, 28 are of non-conducting material and can be if required made of plastic.

I claim:

1. A fuel injection pump for internal combustion engines including a pump housing, a distributor plunger guided in a pump cylinder in said pump housing, said distributor plunger carries out a to-and-from and rotary movement and at the same time delivers an adjustable injection quantity of fuel to separate fuel injection nozzles, a control member is axially translatable on the distributor plunger and displacement of the control member relative to a control passage in the distributor plunger determines the injection quantity of fuel delivered by the distributor plunger, a rotary magnet regulator accommodated in a chamber located in the pump housing, said chamber being divided in a first chamber section (161) and a remaining chamber section (162) by means of separating walls (27 and 28) said walls form throttle openings which connect chambers (161 and 162) with each other, said rotary magnet regulator serves to actuate the control member in dependence on the operating parameters of the internal combustion engine, a rotating armature fitted onto a regulating spindle, an eccentric coupled onto the control member, a damping device coupled to the rotating armature for the purpose of damping any rotary oscillations of the rotating armature, the damping device (25) includes a paddle (26) which is joined firmly to and rotatable with the rotating armature (20), the paddle (26) projects radially from the rotating armature (20) and extends in an axial direction thereby nearly completely covering the cross section of said first chamber section (161) in radial planes of said rotating armature comprising said paddle in consequence of the movement of said paddle following the swivel movement of said armature.

2. A fuel injection pump in accordance with claim 1, in which the throttle openings are formed by outlet gaps between at least one limiting edge of the separating wall (27, 28) on the one hand and the wall of the chamber and/or the rotating armature (20) on the other hand.

3. A fuel injection pump in accordance with claim 1 in which the paddle (26) and the separating wall (27, 28) are made from a piece of plastic.

4. A fuel injection pump in accordance with claim 2 in which the paddle (26) and the separating walls (27, 28) are made from a piece of plastic.

5. A fuel injection pump in accordance with claim 1 in which the paddle (26) and the separating walls (27, 28) are made from magnetically non-conductive sheet metal.

6. A fuel injection pump in accordance with claim 2 in which the paddle (26) and the separating walls (27, 28) are made from magnetically non-conductive sheet metal.

7. A fuel injection pump as set forth in claim 1 in which said paddle has a free outer end.

* * * * *